US011629426B1

(12) United States Patent
Ting et al.

(10) Patent No.: US 11,629,426 B1
(45) Date of Patent: Apr. 18, 2023

(54) SILVER ELECTROPLATING COMPOSITIONS AND METHODS FOR ELECTROPLATING ROUGH MATT SILVER

(71) Applicant: Rohm and Has Electronic Materials LLC, Marlborough, MA (US)

(72) Inventors: Fai Lung Ting, Fanling (CN); Weigang Wu, Fanling (CN)

(73) Assignee: ROHM AND HAAS ELECTRONIC MATERIALS LLC, Marlborough, MA (US)

( * ) Notice: Subject to any disclaimer, the term of this patent is extended or adjusted under 35 U.S.C. 154(b) by 0 days.

(21) Appl. No.: 17/852,825

(22) Filed: Jun. 29, 2022

(51) Int. Cl.
*C25D 3/46* (2006.01)
*C25D 5/00* (2006.01)

(52) U.S. Cl.
CPC ..... *C25D 5/605* (2020.08); *C25D 3/46* (2013.01); *C25D 5/627* (2020.08)

(58) Field of Classification Search
CPC ..... C25D 3/46
See application file for complete search history.

(56) References Cited

U.S. PATENT DOCUMENTS

| | | | |
|---|---|---|---|
| 4,247,372 | A | 1/1981 | Nobel et al. |
| 4,614,568 | A | 9/1986 | Okubo et al. |
| 8,819,930 | B2 | 9/2014 | Wunderlich et al. |
| 10,847,451 | B2 | 11/2020 | Hishiki et al. |

FOREIGN PATENT DOCUMENTS

| | | | |
|---|---|---|---|
| WO | 2010043291 | A1 | 4/2010 |

OTHER PUBLICATIONS

Suzuki et al., Original & Machine Translation, W.O. Int'l Pub. No. 2022/202494 A1 (Year: 2022).*

* cited by examiner

*Primary Examiner* — Hosung Chung
(74) *Attorney, Agent, or Firm* — John J. Piskorski

(57) ABSTRACT

Silver electroplating compositions deposit rough, matt silver having needle-like grain structures. The rough, matt, silver deposits enable good adhesion with dielectric materials, even in environments of high relative humidity.

14 Claims, 2 Drawing Sheets

SILVER ELECTROPLATING COMPOSITIONS AND METHODS FOR ELECTROPLATING ROUGH MATT SILVER

FIELD OF THE INVENTION

The present invention is directed to silver electroplating compositions and methods for electroplating rough, matt silver. More specifically, the present invention is directed to silver electroplating compositions and methods for electroplating rough, matt silver having needle-like or conical-like grain structures to improve adhesion with dielectric materials.

BACKGROUND OF THE INVENTION

Lead-frames are used to mount and process semiconductor dice or chips in the production of semiconductor devices. The Lead-frames electrically connect the chip to external devices via leads of the lead-frame. There are certain types of the lead-frames in the industry, such as spot silver/solder-coated lead-frames and palladium pre-plated lead-frames (PPF).

Conventionally, silver plating is applied to the entirety or a part of the surface of a lead-frame base. The lead-frame bases are made of copper or copper alloy to secure good bonding with metal wires (such as gold wire or copper wire) used at the time of bonding with a semiconductor element. To minimize the undesired diffusion of copper, which resides in the under-lying lead-frame base made of copper or copper alloy, silver or silver alloy is formed directly on the lead-frame base made of the copper or copper alloy without an undercoat plating layer, such as nickel underlayer. The silver or silver alloy layer can have a thickness of 2 μm or more, typically, of 2.5~3.0 μm.

After semiconductor chips are mounted onto the lead-frame base, and the bonding wire connections are made between the chips and the lead-frame base, the semiconductor chips are encapsulated with a plastic molding compound called epoxy molding compound (EMC) to form a package. For the high reliability requirement, a good adhesion between lead-frame base and the EMC of the package is the key to securing proper functioning of integrated circuit (IC) devices. Delamination or cracking of the package, and even the so-called "popcorn" effect, results in device failure.

During the lifetime of the package, ambient moisture may be absorbed at the interface between the EMC and the lead-frame base. Moisture absorption and the retention inside the device results in trapping of the moisture which is then vaporized at elevated temperatures. The vaporizing moisture exerts tremendous internal package stress, which may lead to delamination in the EMC and lead-frame base interface.

To estimate the tendency of a given package to delaminate, Institute for Interconnecting and Packaging Electronic Circuits (IPC) and Solid State Technology Association defined a standard classification of moisture sensitivity levels (MSLs) of lead-frame IC devices. According to this standard (J-STD-020D), which is a specification in the IPC and Solid State Technology Association, there are 8 levels for expressing the moisture sensitivity of the package. MSL 1 corresponds to packages that are immune to delamination regardless of the exposure to moisture while MSL 5 and MSL 6 devices are most prone to moisture induced fracture. To ensure sufficient adhesion under practical conditions, lead-frame IC packages are tested according to the J-STD-20 MSL standard.

Recent trends toward introducing advanced electronic technologies into automobiles has led to a steady increase in the number of automotive semiconductors. Meanwhile, conventional gold wire is increasingly being replaced with lower-cost copper wire to slash semiconductor package costs. However, copper wire has a drawback in that it is easily corroded by an additive containing sulfur atoms that is used for improving the adhesion with the lead-frame. To satisfy strict conditions in reliability tests for automotive conductors specified in the Automotive Electronics Council-Q006 (AEC-Q006), it is crucial to prevent the delamination between EMC and the lead-frame in the reflow process. Furthermore, in other fields such as 5G/Telecom and Storage, there are increasing requests for MSL-1 compliance (Moisture Sensitivity Level-1, 85° C. & 85% relative humidity for 168 hours, J-STD-20). To sum up, the end market demand of IC packages requires a higher reliability and a robust adhesion force between EMC and the lead-frame base.

Typically, the surface of most lead-frame structures consists of two metals, such as copper or a copper alloy from which the lead-frame body structure is made, and silver or silver alloy which is present on the surface of the lead-frame body structure. Silver or an alloy containing silver often has poor adhesion to EMC. To address adhesion between the lead-frame base and EMC, the industry has mainly focused on the copper or copper alloy surface. This may be achieved by chemical etching processes. For example, chemical etching processes can produce a metal oxide layer on the copper or copper alloy surfaces to improve adhesion, as the metal oxide surfaces generally show better adhesion to EMC than oxide-free metal surfaces. In addition to chemical etching processes, electrochemical treatments such as by applying an anodic current to the copper or copper alloy materials can roughen a surface to improve adhesion.

In recent years the industry has focused on reducing the size and cost of semiconductor packages. There has been an increasing demand for high-density packaging where lighter and smaller parts are required. The high-density packages further compromise adhesion between the copper, copper alloys and silver or silver alloys, specifically within the EMC encapsulation. Accordingly, adhesion between the lead-frame base and EMC, as well as the package reliability, especially with respect to moisture sensitivity, is substantially compromised.

Therefore, there is a need for a method to improve adhesion between lead-frames and EMC in semiconductor packaging.

SUMMARY OF THE INVENTION

The present invention is directed to a silver electroplating composition comprising silver ions, a conductivity compound and a compound having a formula:

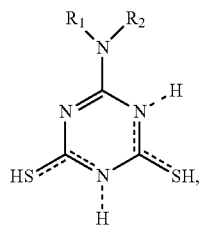

(I)

wherein $R_1$ is hydrogen or $C_1$-$C_4$ alkyl and $R_2$ is $C_1$-$C_4$ alkyl or phenyl.

The present invention is further directed to a method of electroplating rough, matt silver on a substrate including:

a) providing the substrate;

b) contacting the substrate with a silver electroplating composition comprising silver ions, a conductivity compound and a compound having a formula:

(I)

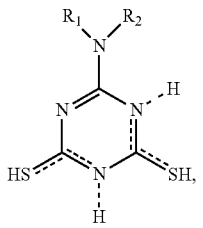

wherein $R_1$ is hydrogen or $C_1$-$C_4$ alkyl and $R_2$ is $C_1$-$C_4$ alkyl or phenyl; and c) applying an electric current to the silver electroplating composition and the substrate to electroplate a rough matt silver deposit on the substrate.

The present invention is further directed to an article comprising a rough, matt silver layer adjacent a surface of a substrate, wherein the rough, matt silver layer has a Sa of 0.1-0.4 μm and an Sdr of 5-50%.

The silver electroplating composition of the present invention enables the electroplating of a rough matt silver deposit on a substrate such that the rough matt silver provides good and reliable adhesion with dielectric materials, such as, but not limited to, an epoxy molding compound (EMC), even in relatively high moisture environments. The rough matt silver of the present invention enables secure adhesion within semiconductor packaging to inhibit delamination or cracking of the package as well as the "popcorn" effect, to prevent IC device failure.

DETAILED DESCRIPTION OF THE INVENTION

Figure 1:
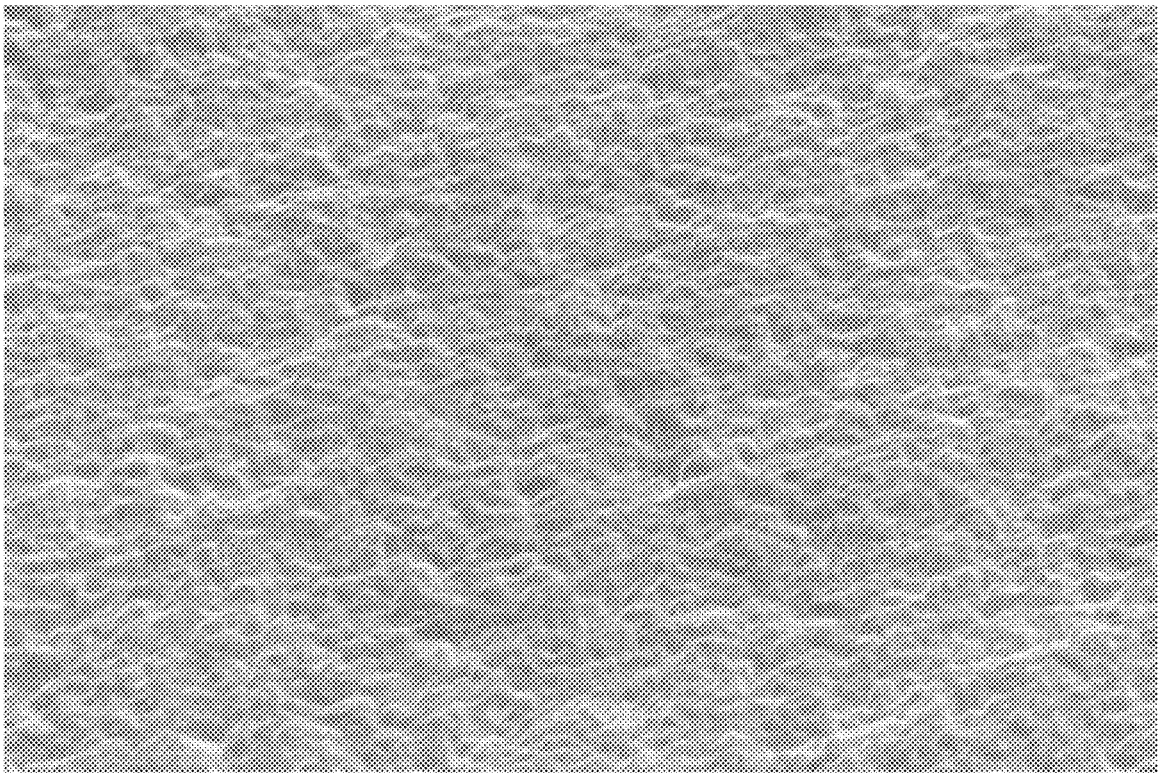
FIG. 1 is a SEM at 5000× taken with a Zeiss microscope of a semi-bright silver layer electroplated with a conventional silver electroplating bath.

As used throughout the specification the abbreviations have the following meanings, unless the context clearly indicates otherwise: °C.=degrees Centigrade; g=gram; ppm=parts per million; Kg=kilogram; L=liter; mL=milliliter; mm=millimeters; cm=centimeter; dm=decimeter; μm=microns; nm=nanometers; DI=deionized; A=amperes; ASD=amperes/$dm^2$=plating speed; DC=direct current; N=newtons; mN=milli-newtons; R.O.=reverse osmosis; R.T.=room temperature; v=volts; s=seconds; sec.=seconds; 3D=three dimensional; rpm=revolutions per minute; MSL-1=Moisture Sensitivity Level-1, 85° C. & 85% relative humidity for 168 hours; w/o MSL-1=without MSL treatment; w/ MSL-1=with MSL treatment; C.D.=current density; Ag=silver; Cu=copper; and S=sulfur.

The term "adjacent" means directly in contact with such that two metal layers have a common interface. The abbreviation "N" means Newtons which is the SI unit of force and it is equal to the force that would give a mass of one kilogram an acceleration of one meter per second per second and is equivalent to 100,000 dynes. The term "Ra" means arithmetic mean deviation in profile roughness. The term "Sa" means arithmetical mean height and is substantially equivalent to Ra. The term "Sdr" means developed interfacial area ratio corresponding to surface ratio with a correlation of Sdr=(surface ratio-1)x100%. The term "aqueous" means water or water-based where organic solvents may be added to help solubilize one or more components in a plating composition or plating bath. The terms "composition" and "bath" are used interchangeably throughout the specification. The terms "deposit" and "layer" are used interchangeably throughout the specification. The terms "electroplating", "plating" and "depositing" are used interchangeably throughout the specification. The term "matt" means dull or without luster but not smokey or foggy in appearance. The term "semi-bright" means that the surface of the article has a haze or slight haze appearance visually but still reflects light in parallel. The term "bright" means the surface of the article reflects light in parallel and has a clear appearance visually. The term "morphology" means shape, size, texture or topography of a surface or article. The term "dielectric" means an insulating material of substantially poor electrical conductivity. The term "haze" means smokey or foggy in appearance. The term "aliquot" means a portion of a larger whole, especially samples taken for chemical analysis or other treatment. The " - - - " in a chemical structure means an optional covalent chemical bond. The term "thio" means an organic compound which includes -S- or -SH in the chemical structure. The terms "a" and "an" can refer to both the singular and the plural throughout the specification. All percent (%) values and ranges indicate weight percent unless otherwise specified. All numerical ranges are inclusive and combinable in any order, except where it is logical that such numerical ranges are constrained to add up to 100%.

The present invention is directed to silver electroplating compositions containing silver ions, a conductivity compound, and a compound having a formula:

(I)

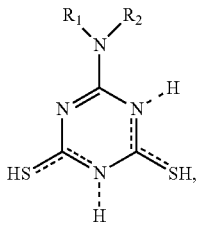

wherein $R_1$ is hydrogen or $C_1$-$C_4$ alkyl and $R_2$ is $C_1$-$C_4$ alkyl or phenyl, preferably, $R_1$ is hydrogen or $C_2$-$C_4$ alkyl and $R_2$ is $C_2$-$C_4$ alkyl or phenyl, more preferably, $R_1$ is hydrogen or $C_4$ alky and $R_2$ is $C_4$ alky or phenyl.

Sources of silver ions can be provided by silver salts such as, but not limited to, silver halides, such as chloride, bromide and fluoride, silver gluconate, silver citrate, silver lactate, silver nitrate, silver sulfates, silver alkane sulfonates, silver alkanol sulfonates, silver potassium cyanide or mixtures thereof. When a silver halide is used, preferably, the halide is chloride. Preferably, the silver salts are silver potassium cyanide, silver nitrate, a silver alkane sulfonate, or mixtures thereof, more preferably, the silver salt is silver potassium cyanide, silver nitrate or mixtures thereof. The silver salts are generally commercially available or can be prepared by methods described in the literature. Preferably, the silver salts are readily water-soluble. No alloying metals or metals for purposes of brightening the silver deposit are included in the silver electroplating compositions of the present invention.

Preferably, silver salts are included in the compositions to provide silver ions at concentrations of at least 10 g/L, more preferably, silver salts are included in the compositions in amounts to provide silver ion concentrations in amounts of 10 g/L to 100 g/L, further preferably, silver salts are included in amounts to provide silver ion concentrations of 20 g/L to 80 g/L, even more preferably, silver salts are included in amounts to provide silver ions at concentrations of 20 g/L to 60 g/L, most preferably, silver salts are included in the compositions in amounts to provide silver ion concentrations of 30 g/L to 60 g/L.

Conducting compounds included in the silver electroplating compositions of the present invention include water-soluble salts to support an electrical current in the silver electroplating compositions during electroplating of silver. Conducting salts include, but are not limited to, potassium dihydrogen phosphate, sodium dihydrogen phosphate, potassium phosphate, sodium phosphate, ammonium phosphate, sodium pyrophosphate, potassium pyrophosphate, ammonium pyrophosphate, sodium nitrate, nitrites, citrates, tartrates, salts of organic acids, salts of inorganic acids and mixtures of one or more of the foregoing conductive salts. Preferably, the conducting salts are potassium dihydrogen phosphate, potassium phosphate, sodium phosphate, ammonium phosphate, sodium nitrate or mixtures thereof. More preferably, the conducting salts are potassium dihydrogen phosphate, sodium nitrate or mixtures thereof. Most preferably, the conducting salt is potassium dihydrogen phosphate.

Organic acids which can be included in the silver electroplating compositions of the present invention include, but are not limited to, acetic acid, citric acid, malonic acid, arylsulfonic acids, alkanesulfonic acids, such as methanesulfonic acid, ethanesulfonic acid and propanesulfonic acid, aryl sulfonic acids such as phenylsulfonic acid, tolylsulfonic acid, 5-sulfosalicylic acid. Salts of the foregoing acids also can be included in the silver electroplating compositions of the present invention.

Inorganic acids which can be included in the silver electroplating compositions of the present invention include, but are not limited to, sulfuric acid, sulfamic acid, hydrochloric acid, phosphoric acid, hydrobromic acid and fluoroboric acid. Water-soluble salts of the foregoing acids also can be included in the silver electroplating compositions of the present invention. Mixtures of acids and their salts can be used. The acids, both organic and inorganic, are generally commercially available or can be prepared by methods known in the literature.

Preferably, conducting compounds are included in amounts of at least 50 g/L, more preferably, from 50 g/L to 250 g/L, even more preferably, from 50 g/L to 150 g/L, most preferably from 80 g/L to 125 g/L.

Compounds having the formula (I) above are included in the silver electroplating compositions of the present invention as roughening agents to provide a rough matt silver deposit. Such compounds are included in the silver electroplating compositions of the present invention, preferably, in amounts of at least 1 ppm, more preferably, from 5-100 ppm, even more preferably, from 5-50 ppm, most preferably, from 5-20 ppm.

The most preferred compounds have the formulae below.

(II)

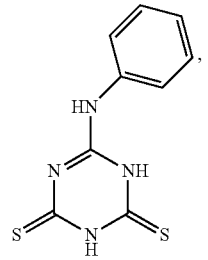

6-anilino-1,3,5-triazine-2,4-dithiol (III)

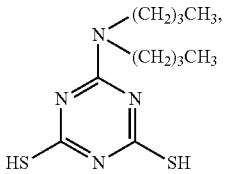

6-(dibutylamino)-1,3,5-triazine-2,4-dithiol

Optionally, one or more buffering agents and pH adjusting agents can be included in the silver electroplating compositions to maintain a desired pH. Buffering agents include, but are not limited to, boric acid, salts thereof, such as boric acid disodium salt, boric acid potassium salt, boric acid ammonium salt and mixtures thereof, citric acid and salts of citric acid, such as potassium, sodium, ammonium salts, or mixtures thereof.

Optional agents for adjusting the pH include, but are not limited to, potassium hydroxide, sodium hydroxide, ammonium hydroxide, citric acid, salts of citric acid, such as potassium citrate, sodium citrate and ammonium citrate, phosphates, carbonates, phosphoric acid and mixtures thereof.

Preferably, buffering agents and pH adjusting agents are included in the silver electroplating compositions in amounts of 10 g/L and greater, more preferably from 15 g/L to 100 g/L, even more preferably, from 15 g/L to 70 g/L. Most preferably, boric acid and salts thereof can be included in amounts of 15 g/L to 25 g/L. Most preferably, pH adjusting agents can be included in amounts of 30 g/L to 70 g/L.

Preferably, the pH of the silver electroplating compositions of the present invention ranges from 6-14, more preferably, from 7-13, even more preferably, from 8-12, most preferably, from 8-10.

Optionally, the silver electroplating compositions of the present invention include one or more silver complexing agents. Such complexing agents include, but are not limited to, potassium cyanide, hydantoin, hydantoin derivatives, such as 5,5-dimethyl hydantoin, succinimide and derivatives thereof, maleimide and derivatives thereof, and nicotinic acid. A preferred silver complexing agent is potassium cyanide.

Such silver complexing agents are included in conventional amounts which are well known to those of ordinary skill in the art. Preferably, the silver complexing agents are included in amounts of at least 5 g/L, more preferably, 5-100 g/L, even more preferably from 5-50 g/L, most preferably, from 5-25 g/L.

Optionally, the silver electroplating compositions of the present invention can include one or more conventional grain refiners. Such grain refiners can include, but are not limited to, one or more of thiomalic acid, 2-mercaptosuccinic acid, 3-mercapto-1-propanesulfonic acid, 1-[2-(dimethylamino)ethyl]-1H-tetrazole-5-thiol, and salts thereof. Preferably, the silver electroplating compositions of the present invention exclude such grain refiners.

When the grain refiners are included, they can be included in amounts of 5 g/L or greater, more preferably, in amounts of 10 g/L to 100 g/L.

In the silver electroplating compositions of the present invention, water is included as solvent and is, preferably, at least one of deionized water and distilled water to limit incidental impurities.

Optionally, the silver electroplating compositions of the present invention can include one or more organic solvents to assist in solubilizing composition components in water. Such organic solvents include pyridine, pyridine compounds, or mixtures thereof. Preferably, such pyridine compounds consist of 2-pyridinemethanol, 3-pyridinemethanol, 2-pyridineethanol, 3-pyridineethanol and mixtures thereof in combination with water. Preferably, when the solvent includes a pyridine compound, the solvent of the silver electroplating composition consists of 3-pyridinemethanol and water. Preferably, such compounds are included in the silver electroplating compositions of the present invention in amounts of 0.1 g/L to 2 g/L, more preferably, in amounts of 0.2 g/L to 1 g/L, even more preferably, from 0.2 g/L to 0.5 g/L.

Optionally, one or more surfactants can be included in the silver electroplating compositions of the present invention. Such surfactants include, but are not limited to, ionic surfactants such as cationic and anionic surfactants, non-ionic surfactants, and amphoteric surfactants. Surfactants can be included in conventional amounts such as 0.05 g/L to 30 g/L.

Examples of anionic surfactants are sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate. Examples of cationic surfactants are quaternary ammonium salts such as perfluorinated quaternary amines.

Other optional additives can include, but are not limited to, levelers and biocides. Such optional additives can be included in conventional amounts.

Preferably, the silver electroplating compositions consist of water, optionally pyridine, 2-pyridinemethanol, 3-pyridinemethanol, 2-pyridineethanol, 3-pyridineethanol, or mixtures thereof, silver ions, counter anions, a conducting compound, a compound of formula (I), optionally a buffering agent, optionally a pH adjusting agent, optionally an acid, optionally a grain refiner, optionally a surfactant, optionally a leveler, optionally a biocide and a pH of 6-14.

More preferably, the silver electroplating compositions consist of water, optionally 2-pyridinemethanol, 3-pyridinemethanol, 2-pyridineethanol, 3-pyridineethanol, or mixtures thereof, silver ions, counter anions, a conducting compound, a compound selected from the group consisting of 6-(dibutylamino)-1,3,5-triazine-2,4-dithiol, 6-amino-1,3,5-triazine-2,4-dithiol and mixtures thereof, optionally boric acid or salt thereof, optionally potassium hydroxide, sodium hydroxide, ammonium hydroxide or mixtures thereof, optionally an acid, optionally a surfactant, optionally a leveler, optionally a biocide and a pH of 7-13.

Even more preferably, the silver electroplating compositions consist of water, optionally 3-pyridinemethanol, silver ions, counter anions, a conducting compound, a compound selected from the group consisting of 6-(dibutylamino)-1,3,5-triazine-2,4-dithiol, 6-amino-1,3,5-triazine-2,4-dithiol and mixtures thereof, optionally boric acid or salt thereof, optionally potassium hydroxide, sodium hydroxide, ammonium hydroxide or mixtures thereof, optionally a surfactant, optionally a leveler, optionally a biocide and a pH of 8-12.

Most preferably, the silver electroplating compositions consist of water, optionally 3-pyridinemethanol, silver ions, counter anions, a conducting compound, a compound selected from the group consisting of 6-(dibutylamino)-1,3,5-triazine-2,4-dithiol, 6-amino-1,3,5-triazine-2,4-dithiol and mixtures thereof, optionally boric acid or salt thereof, optionally potassium hydroxide, sodium hydroxide, ammonium hydroxide or mixtures thereof, optionally a surfactant, optionally a leveler, optionally a biocide and a pH of 8-10.

The silver electroplating compositions of the present invention can be used to deposit rough, matt silver layers on various substrates. Preferably, the substrates on which rough, matt silver layers are deposited include copper and copper alloy layers. Such copper alloy layers include, but are not limited to, brass and bronze. Preferably, the silver electroplating compositions of the present invention are used to plate rough, matt silver layers adjacent copper and copper alloy layers. Preferably, such copper and copper alloy layers are included in lead-frame fabrication and IC semiconductor packaging. Preferably, the rough, matt silver layer is electroplated adjacent a silver strike layer which is adjacent to the copper or copper alloy of the lead frame base or substrate. Such silver strike layers, preferably, range from 10-20 nm. Silver strike layers are deposited adjacent the copper or copper alloy by using conventional silver electroplating baths or by electroless silver metal plating baths. A dielectric material called an epoxy molding compound is used to encase the lead-frame with the silver layers and copper or copper alloy to complete the lead-frame and IC semiconductor package. The IC packages which include the rough, matt silver layers of the present invention enable good adhesion with epoxy molding compounds to prevent delamination of molding compounds and can be expected to have MSL-1 compliance (Moisture Sensitivity Level-1, 85° C. & 85% relative humidity for 168 hours, J-STD-20).

The silver electroplating compositions of the present invention can be electroplated at temperatures from room temperature to 70° C., preferably, from 30° C. to 60° C., more preferably, from 40° C. to 60° C. The silver electroplating compositions are preferably under continuous agitation during electroplating.

The silver electroplating method of the present invention includes providing a substrate, providing the silver electroplating composition and contacting the substrate with the silver electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating silver to deposit adjacent a surface of a substrate.

Current densities for electroplating the rough, matt silver can range from 5 ASD or higher. Preferably, the current densities range from 10 ASD to 180 ASD, further preferably, from 20 ASD to 150 ASD, even more preferably, from 100 ASD to 150 ASD. Preferably, high current densities are used to plate silver to achieve the desired rough, matt silver deposit.

The silver electroplating compositions of the present invention enable deposition of rough matt and uniform silver layers. The silver content of the deposits is greater than or equal to 99% silver by metals basis.

The rough, matt silver layers have a Sa of, preferably, 0.1-0.4 μm, more preferably, 0.2-0.3 μm and an Sdr of, preferably, 5-50%, more preferably, 25-30%. The Sa and Sdr can be measured for silver layers using conventional methods and apparatus used to measure surface roughness known to those of ordinary skill in the art. One method is to use an Olympus 3D Laser Microscope-LEXT OLS5000-LAF (available from Olympus Scientific Solutions Americas). The surface roughness can be scanned on a surface area of, for example, 256 μmx256 μm with 50× objective magnification.

The rough, matt silver deposits have needle-like or acicular-like structures with peak heights ranging from 1-4 μm and diameters at peak base of 0.2-0.4 μm. Such parameters can be measured using an Olympus 3D Laser Microscope-LEXT OLS5000-LAF. Other methods and apparatus can be used as are well known to those of ordinary skill in the art.

Preferably, the thickness of the rough, matt silver layer ranges from 0.1 μm or greater. Further preferably, the rough matt silver layer has a thickness range of 0.1 μm to 10 μm, more preferably, from 0.5 μm to 5 μm, even more preferably, from 2 μm to 4 μm, most preferably, from 2 μm to 3 μm. Thickness can be measured by conventional methods known to those of ordinary skill in the art. For example, thickness of the silver layers can be measured using a Bowman Series P X-Ray Fluorimeter (XRF) available from Bowman, Schaumburg, Ill. The XRF can be calibrated using pure silver thickness standards from Bowman.

The following examples are included to further illustrate the invention but are not intended to limit its scope.

EXAMPLE 1

Button Shear Test

A plurality of copper coupons was provided having dimensions of 0.27 dmx0.06 dmx2 sides to provide an area of each coupon of 0.032 $dm^2$. The Sa and Sdr of the copper coupons were determined using an Olympus 3D Laser Microscope-LEXT OLS5000-LAF. The Sa ranged from 0.076-0.085 μm. The average was 0.08 μm. The Sdr ranged from 1.26-1.49%. The average was 1.40%.

An aliquot of the copper coupons was roughened according to the procedure described in Tables 1 and 2.

TABLE 1

| Component | Amount |
|---|---|
| CIRCUBOND ™ Treatment 180C[1] | 140 mL/L |
| CIRCUBOND ™ Treatment 180B[1] | 1.6 mL/L |
| 35% Hydrogen Peroxide | 25 mL/L |
| DI Water | To one Liter |

[1]CIRCUBOND ™ products are available from Rohm and Haas Electronic Materials LLC.

TABLE 2

| Operating Parameter | Condition |
|---|---|
| Temperature | 35-39° C. |
| Immersion time | 1 minute |
| Agitation | Stirring |
| Post Treatment | DI Water Rinsing |

Sa and Sdr of the roughened copper coupons were measured with an Olympus 3D Laser Microscope-LEXT OLS5000-LAF. The Sa values ranged from 0.199-0.242 μm with a mean value of 0.218 μm. The Sdr values ranged from 18.5-23.9% with a mean value of 20.7%.

A second and third aliquot were electroplated with a silver layer from a conventional silver plating bath or a matt rough silver layer with a silver electroplating bath of the invention described below. A fourth aliquot of copper coupons was not roughened nor silver electroplated.

TABLE 3

Process Metallization on Copper Coupons

| Step # | Process | Chemical Bath | Concentrations | Current (current density) | Temperature | Time |
|---|---|---|---|---|---|---|
| 1 | Electro-cleaning[1] | Ronaclean ™ GP-300 | 60 g/L | 4~6 v | 60° C. | 30 sec. |
| 2 | Rinsing | R.O. Water | — | — | R.T. | 5 sec. |
| 3 | Activation[2] | Actronal ™ 988 solution | 100 g/L | — | R.T. | 5 sec. |
| 4 | Rinsing | R.O. Water | — | — | R.T. | 5 sec. |
| 5 | Silver Strike | Potassium silver cyanide and Potassium cyanide in water | 2.4 g/L and 100 g/L, respectively | 0.2 A (1.5 ASD) | R.T. | 20 sec. |
| 6 | Rinsing | R.O. Water | — | — | R.T. | 5 sec. |
| 7 | Silver Plating by Jet plater | Silverjet[3] 220 SE and Rough Matt Silver | See Tables 4-5 | 2.56 A (100 ASD) | 60° C. | 3.0 sec. |
| 8 | Rinsing | R.O. Water | — | — | R.T. | 5 sec. |
| 9 | Drying | By hot gun | — | — | — | — |

[1]Ronaclean ™ GP-300 Solution is available from Rohm and Haas Electronic Materials LLC.
[2]Actronal ™ 988 Solution is available from Rohm and Haas Electronic Materials LLC.
[3]Silverjet ™ 220 SE Silver Electroplating Bath and products are available from Rohm and Haas Electronic Materials LLC.

Silver strike was electroplated on the copper coupons to a thickness of 0.1-0.2 μm. The thickness of the silver strike layer was measured with a Bowman Series P X-Ray Fluorimeter (XRF). Silver plating was done in a 1 L plastic container using an insoluble stainless steel anode.

TABLE 4

(Invention)
Rough Matt Silver Bath

| Components | Amount |
|---|---|
| Potassium silver cyanide | 74 g/L |
| (silver ions) | (40 g/L) |
| Boric acid | 25 g/L |
| Potassium hydroxide | 54 g/L |
| Potassium dihydrogen phosphate | 100 g/L |
| 6-Anilino-1,3,5-triazine-dithiol | 10 ppm |
| Water | To 1 Liter |

Silver electroplating was done at a pH of 9-9.5. A jet plater for high speed silver plating was used (1010 Spot Plating Machine by Kam Tsuen Mechanical & Electrical Ltd.). The silver layer had a thickness of 2.5-3 μm as measured using a Bowman Series P X-Ray Fluorimeter (XRF) available from Bowman, Schaumburg, Ill. The XRF was calibrated using pure silver thickness standards from Bowman.

TABLE 5

(conventional bath)
Semi-Bright Silver Bath (Silverjet ™ 220 SE[4])

| Components | Amount |
|---|---|
| Potassium silver cyanide (silver ions) | 74 g/L (40 g/L) |
| Silverjet ™ Make-Up Solution (conductivity salt + buffer) | 500 mL/L |
| Silverjet ™ Conditioner (surfactant) | 0.5 mL/L |
| Silverjet ™ 220 Brightener (grain refiner) | 5 mL/L |
| Silverjet ™ Special Additive (anti-immersion agent) | 5 mL/L |
| Water | To 1 Liter |

[4]Silverjet ™ 220 SE Semi-Bright Silver Bath and products are available from Rohm and Haas Electronic Materials LLC. The formulation is free of the compounds 6-anilino1,3,5-triazine-2,4-dithiol and 6-(dibutylamino)-1,3,5-triazine-2,4-dithiol.

Silver electroplating was done at a pH of 9-9.5. The silver layer had a thickness of 2.5-3 μm as measured by the Bowman Series P X-Ray Fluorimeter (XRF). The XRF was calibrated using pure silver thickness standards from Bowman.

The Sa and Sdr were measured for the silver layers from each of the two types of silver electroplating baths. The surface roughness was analyzed using an Olympus 3D Laser Microscope-LEXT OLS5000-LAF (available from Olympus Scientific Solutions Americas). The surface roughness was scanned on a surface area of 256 μmx256 μm with 50× objective magnification.

The semi-bright silver layers plated from the Silverjet™ 220 SE Silver Electroplating Bath had Sa values ranging from 0.09-0.12 μm and Sdr values ranging from 0.5-1.7%. FIG. 1 is a SEM at 5000× of a surface of a silver layer from one of the silver plated coupons taken with a Zeiss microscope.

Figure 2:
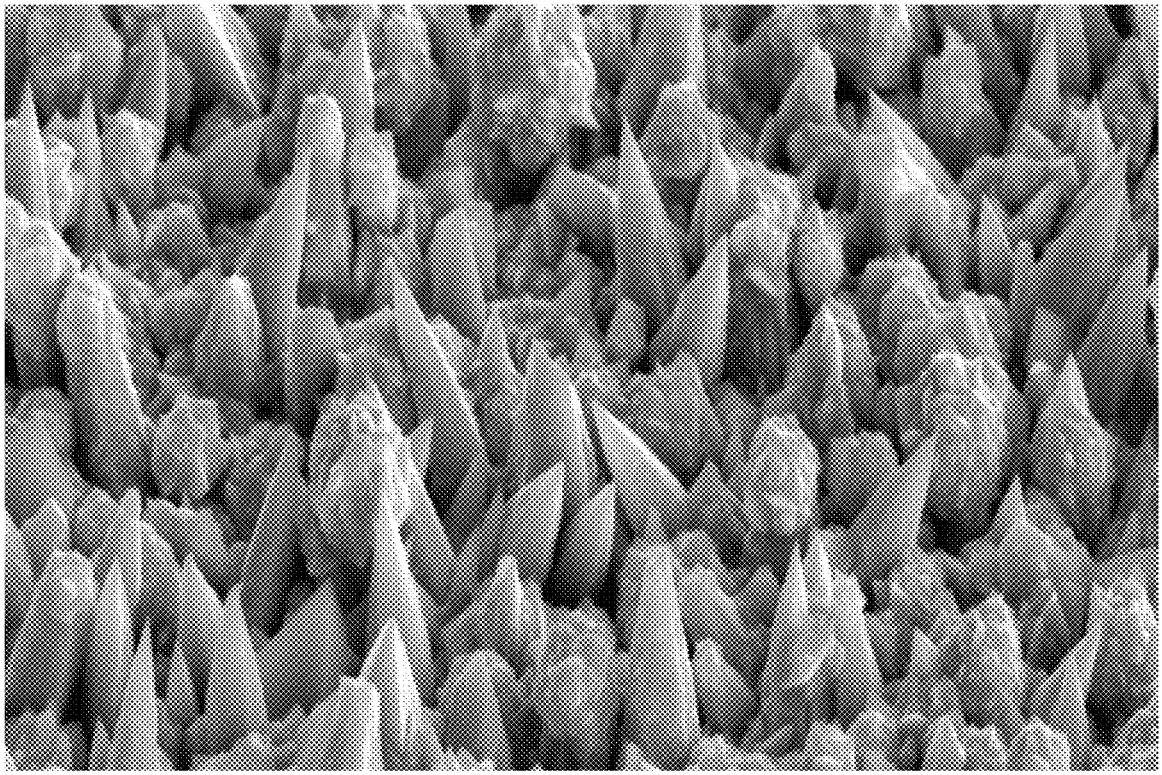
FIG. 2 is a SEM at 5000× taken with a Zeiss microscope of a matt rough silver layer electroplated with a silver electroplating bath of the invention.

In contrast, the Sa values of the silver surface plated on the copper coupons from the silver electroplating bath of the invention ranged from 0.15-0.3 μm and had an Sdr ranging from 12-30%. FIG. 2 is a SEM at 5000× of a surface of a silver layer from one of the silver plated coupons taken with a Zeiss microscope. The silver surface of FIG. 2 has a rough and acicular morphology in contrast to that of FIG. 1. The silver electroplating bath of the invention had a substantially rougher silver deposits than the silver layers plated from the conventional silver plating bath.

All the coupons were then coated with molding compound EME-, a mixture of epoxy resin (5-10%), phenol resin (1-5%), amorphous silica A (70-80%), amorphous silica B (5-10%) and carbon black (0.1-1%). The molding compound was molded into a button shape and cured at 175° C. in a conventional oven for 120 sec. The coupons with the button shaped molding compound were then post-mold cured at 175° C. for 4 hours. The coupons were cooled to room temperature. Half of the coupons with the button shaped molding underwent exposure to Moisture Sensitivity Level-1, 85° C. & 85% relative humidity for 168 hours using EXPEC bench-top type Temperature & Humidity Chamber, model SH-221. The coupons were placed in a stainless steel basket in the chamber and set at 85° C. at relative humidity of 85% for the 168 hours (7 days). The coupons were then removed from the chamber and dried in the ambient environment.

The button shear test was then done on all the coupons. The button shear test conditions are below:

a) Shear equipment: 4000 Multipurpose Bondtester available from Nordson
b) Cartridge: DAGE-4000-DG100KG
c) Button height: 3 mm
d) Button diameter: 3 mm
e) Shear height: 20% of button=600 μm
f) Shear speed: 85 μm/s
g) Temperature: Room temperature The results of the button shear test for the silver plated copper coupons, the roughened copper and the un-roughened copper are in Table 6 below.

TABLE 6

| Treatment | Rough Matt Ag Shear Force | Conventional Ag Shear Force | Rough Cu Shear Force | Untreated Cu Shear Force |
|---|---|---|---|---|
| w/o MSL-1 | 31.3 Kg | 19.6 Kg | 25.5 Kg | 26 Kg |
| w/MSL-1 | 27 Kg | 16.5 Kg | 23.1 Kg | 20.4 Kg |
| Diff. % of Shear Force | −13.7% | −15.8% | −9.4% | −21.5% |

For the treatment w/o MSL-1, the shear force for the rough matt silver was 31.3 Kg while the shear force for the conventional silver was 19.6 kg. The increment was (31.3 Kg-19.6 Kg)/19.6 Kgx100=59.7%. For the treatment w/MSL-1, the shear force for the matt rough silver was 27 Kg and the conventional silver was 16.5 Kg. The increment was (27 Kg-16.5 Kg)/16.5 Kgx100=63.6%. The results showed that the rough matt silver plated from the rough matt silver bath had a high and improved molding shear force over the silver plated from the conventional silver bath. For the w/o MSL-1, the shear force of the rough matt silver had an improved molding shear force of almost 60%. For the w/MSL-1, the shear force of the rough matt silver of the invention had an improved molding shear force of 63.6%. The shear force of the rough matt silver was also higher than that of the rough copper surface and the untreated copper surface.

Although there was adhesion force reduction after MSL-1 treatment of the rough matt silver, it was still higher than the conventional silver deposit, the roughened copper surfaces and the untreated copper surfaces. The rough matt silver enhanced adhesion between molding material and silver surface coatings, even under high moisture environments.

EXAMPLE 2

Roughness Analysis of Silver Layers at High Electroplating Speeds

A plurality of C194 copper coupons with dimensions of 0.27 dmx0.25 dm were provided. The C194 coupons are a type of semiconductor material used to form lead-frames. The C194 coupons were composed of copper (≥97%), iron (2.1-2.6%), phosphorous (0.015-0.15%) and zinc (0.05-0.2%). Silver plating area on the coupons was 0.0256 $dm^2$ (0.16 dmx0.16 dm).

The pH of the baths was 9-9.5. Electroplating was done with a jet plater as in Example 1 above. Control bath 1 and invention baths 1-2 were plated at 150 ASD and control bath 2 and invention baths 3-4 were plated at 180 ASD. A semi-bright silver deposit was plated on copper coupons plated with control baths 1 and 2. A rough matt silver deposit was plated on copper coupons plated with invention baths 1-4. The thickness of the silver deposits was 2.5-3 μm.

The surface roughness was measured using an Olympus 3D Laser Microscope-LEXT OLS5000-LAF as described in Example 1 above. The Sa and Sdr values for the plated coupons are in the table below.

TABLE 7

Process Metallization on Copper Coupons

| Step # | Process | Chemical Bath | Concentration | Current (Current Density) | Temperature | Time |
|---|---|---|---|---|---|---|
| 1 | Electro-cleaning | Ronaclean ™ GP-300 | 60 g/L | 4~6 v | 60° C. | 30 sec. |
| 2 | Rinsing | R.O. Water | — | — | R.T. | 5 sec. |
| 3 | Activation | Actronal ™ 988 solution | 100 g/L | — | R.T. | 5 sec. |
| 4 | Rinsing | R.O. Water | — | — | R.T. | 5 sec. |
| 5 | Silver Strike (0.2-0.3 μm) | Potassium silver cyanide, and potassium cyanide in water | 2.4 g/L and 100 g/L, respectively | 0.2 A (1.5 ASD) | R.T. | 20 sec. |
| 6 | Rinsing | R.O. Water | — | — | R.T. | 5 sec. |
| 7 | Aqueous Silver Plating by Jet plater | See Table 8 | See Table 8 | 3.84 A (150 ASD) 4.61 A (180 ASD) | 60° C. | 2.0 sec. 1.8 sec. |
| 8 | Rinsing | R.O. Water | — | — | R.T. | 5 sec. |
| 9 | Drying | (By hot gun) | — | — | — | — |

TABLE 8

Aqueous Silver Electroplating Baths

| Component | Control Bath 1 | Control Bath 2 | Invention Bath 1 | Invention Bath 2 | Invention Bath 3 | Invention Bath 4 |
|---|---|---|---|---|---|---|
| Potassium silver cyanide (Ag+) | 74 g/L (40 g/L) | 74 g/L (40 g/L) | 74 g/L (40 g/L) | 74 g/L (40 g/L) | 74 g/L (40 g/L) | 74 g/L (40 g/L) |
| Boric acid | 50 g/L | 50 g/L | 50 g/L | 50 g/L | 50 g/L | 50 g/L |
| Potassium hydroxide | 22 g/L | 31 g/L | 22 g/L | 22 g/L | 31 g/L | 31 g/L |
| Potassium nitrate | — | — | 80 g/L | 80 g/L | — | — |
| Potassium dihydrogen phosphate | — | — | — | — | 50 g/L | 50 g/L |
| 6-anilino-1,3,5-triazine-2,4-thiol | — | — | 10 ppm | — | 10 ppm | — |
| 6-(dibutylamino)-1,3,5-triazine-2,4-dithiol | — | — | — | 10 ppm | — | 10 ppm |
| Water | To 1 L | To 1 L | To 1 L | To 1 L | To 1 L | To 1 L |

TABLE 9

| Roughness Analysis | | | |
|---|---|---|---|
| Bath | Current Density (ASD) | Sa | Sdr |
| Control 1 | 150 | 0.168 | 15.8% |
| Control 1 | 180 | 0.294 | 30% |
| Control 2 | 150 | 0.157 | 14.7% |
| Control 2 | 180 | 0.290 | 29.4% |
| Invention 1 | 150 | 0.225 | 21.5% |
| Invention 1 | 180 | 0.37 | 38% |
| Invention 2 | 150 | 0.21 | 19.6% |
| Invention 2 | 180 | 0.418 | 39.6% |
| Invention 3 | 150 | 0.233 | 24% |
| Invention 3 | 180 | 0.36 | 39.6% |
| Invention 4 | 150 | 0.277 | 31.8% |
| Invention 4 | 180 | 0.415 | 43.4% |

The results of the roughness analysis showed that the silver deposits plated from the baths of the present invention had substantially rougher surfaces than the silver deposits plated from the control or conventional silver baths when plated at current densities of 150 ASD and 180 ASD.

EXAMPLE 3

Hull Cell Test for Silver Electroplating Baths Containing Thio Organic Compounds as Roughening Agents A plurality of brass panels having dimensions 10 cmx7.5 cm with a plating area of 10 cmx5 cm was provided for silver electroplating in Hull cells with a current density range of 20-50 ASD. The brass panels were treated for plating and silver electroplated according to the process described in Table 10 below.

TABLE 10

| Step # | Process | Chemical Bath | Concentration | Current (Current Density) | Temperature | Time |
|---|---|---|---|---|---|---|
| 1 | Electro-cleaning | Ronaclean ™ GP-300 | 60 g/L | 4 v | 60° C. | 30 sec. |
| 2 | Rinsing | R.O. Water | — | — | R.T. | 5 sec. |
| 3 | Activation | Sulfuric acid solution | 10% | — | R.T. | 10 sec. |
| 4 | Rinsing | R.O. Water | — | — | R.T. | 5 sec. |
| 5 | Silver Strike (0.2-0.3 μm) | Potassium silver cyanide or potassium cyanide | 2.4 g/L or 100 g/L | 2 A (1.3 ASD) | R.T. | 20 sec. |
| 6 | Rinsing | R.O. Water | — | — | R.T. | 5 sec. |
| 7 | Aqueous Silver Plating by Jet plater | See Table 11 | See Table 11 | 10 A | 60° C. | 15 sec. |
| 8 | Rinsing | R.O. Water | — | — | R.T. | 5 sec. |
| 9 | Drying | (By hot gun) | — | — | — | — |

TABLE 11

| Aqueous Silver Electroplating Baths | |
|---|---|
| Component | Concentration |
| Potassium silver cyanide [Ag+] | 111 g/L [60 g/L] |
| Potassium nitrate | 80 g/L |
| Boric acid | 50 g/L |
| Potassium hydroxide | 22 g/L |
| Thio compound (roughening agent) | 5 ppm or 10 ppm |
| Water | To 1 L |

TABLE 12

| Hull Cell Silver Electroplating Parameters | |
|---|---|
| Parameter | Amount |
| Hull cell current density | 20-50 ASD |
| Current | 10 A |
| Plating time | 15 sec. |
| Plating temperature | 60° C. |
| Agitation | 520 rpm by propeller stirring |
| Plating bath pH | 9-9.5 |
| Silver layer thickness | 2.5-3 μm |

After the panels were plated with silver and dried, they were inspected with the naked eye for appearance. Silver layers which appeared semi-bright to bright and hazy indicated a substantially smooth surface. Silver layers which appeared matt or dull indicated a substantially rough surface. The plating results are disclosed in Table 13.

TABLE 13

| BATH # | Thio Compound | Silver Appearance at 5 ppm of Thio Compound | Silver Appearance at 10 ppm of Thio Compound |
|---|---|---|---|
| 0 | None (control) | Semi-bright (no compound) | Semi-bright (no compound) |
| 1 (invention) | 6-Anilino-1,3,5-triazine-2,4-dithiol | Matt | Matt |
| 2 (invention) | 6-(Dibutylamino)-1,3,5-triazine-2,4-dithiol | Matt | Matt |
| 3 (comparative) | 4(5)-Imidazole dithiocarboxylic acid | Bright | Bright |
| 4 (comparative) | Bis(carboxymethyl) trithiocarbonate | Semi-bright to bright | Semi-bright to bright |
| 5 (comparative) | 2-Mercaptobenzothiazole | Haze to semi-bright | Haze to semi-bright |
| 6 (comparative) | 5-Amino-1,3,4-thiadiazole-2-thiol | Semi-bright | Semi-bright |
| 7 (comparative) | 2,5-Dimercapto-1,3,4-thiadiazole | Semi-bright | Semi-bright |
| 8 (comparative) | N,N-dimethyldithiocarbamic acid-Na-Salt | Semi-bright | Not Available |
| 9 (comparative) | 2-Thiouracil | Bright | Bright |
| 10 (comparative) | 1-Allyl-2-thiourea | Bright band | Bright band |
| 11 (comparative) | 1-phenyl-2-thiourea | Bright band | Bright band |
| 12 (comparative) | Diphenylthiocarbazone | Haze to semi-bright | Haze to semi-bright |
| 13 (comparative) | 2-Mercaptobenzimidazole | Semi-bright | Semi-bright |
| 14 (comparative) | 2-Mercapto-1-methyl-imidazole | Semi-bright | Semi-bright |
| 15 (comparative) | 4,5-Diamino-6-hydroxy-2-mercaptopyrimidine | Semi-bright | Semi-bright |
| 16 (comparative) | 2-Thiobarbituric acid | Semi-bright | Semi-bright |
| 17 (comparative) | 1H-1,2,4-Triazole-3-thiol | Semi-bright | Semi-bright |
| 18 (comparative) | 3-Amino-1,2,4-triazole-5-thiol | Semi-bright | Semi-bright |
| 19 (comparative) | 5-Mercapto-1H-tetrazole-1-methanesulfonic acid, disodium salt | Semi-bright | Semi-bright |
| 20 (comparative) | 5-Mercapto-(1H)-tetrazolylacetic acid Sodium salt | Semi-bright | Semi-bright |
| 21 (comparative) | 5-Merpcato-1-methyltetrazole (5-Merpcato-1-methyl-1H-tetrazole) | Semi-bright | Semi-bright |
| 22 (comparative) | 1-(4-Hydroxyphenyl)-1H-tetrazole-5-thiol | Semi-bright | Semi-bright |
| 23 (comparative) | 5-(3-Pyridyl)-4H-1,2,4,-triazole-3-thiol | Semi-bright | Semi-bright |
| 24 (comparative) | 2-Mercapto-5-benzimidazolesulfonic acid sodium salt dihydrate | Semi-bright | Semi-bright |
| 25 (comparative) | 2-Aminothiazole | Semi-bright | Semi-bright |

Only the silver electroplating baths which included 6-anilino-1,3,5-triazine-2,4-dithiol and 6-(dibutylamino)-1,3,5-triazine-2,4-dithiol provided a substantially rough matt silver deposit.

What is claimed is:

1. A silver electroplating composition comprising silver ions, a conductivity compound and a compound having a formula:

(I)

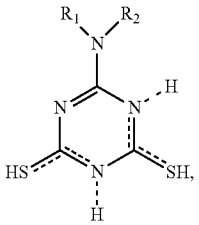

wherein $R_1$ is hydrogen or $C_1$-$C_4$ alkyl and $R_2$ is $C_1$-$C_4$ alkyl or phenyl.

2. The silver electroplating composition of claim 1, wherein the compound is selected from the group consisting of 6-(dibutylamino)-1,3,5-triazine-2,4-dithiol, 6-anilino-1,3,5-triazine-2,4-dithiol and mixtures thereof.

3. The silver electroplating composition of claim 1, wherein the compound is in amounts of at least 1 ppm.

4. The silver electroplating composition of claim 1, wherein the conductivity compound comprises potassium dihydrogen phosphate, potassium phosphate, sodium phosphate, ammonium phosphate, sodium nitrate, organic acids, inorganic acids or mixtures thereof.

5. The silver electroplating composition of claim 1, further comprising a buffering agent.

6. The silver electroplating composition of claim 1, further comprising a pH adjusting agent.

7. The silver electroplating composition of claim 1, further comprising a silver complexing agent.

8. The silver electroplating composition of claim 1, further comprising an organic solvent chosen from pyridine and pyridine compounds.

9. The silver electroplating composition of claim 8, wherein the pyridine compound consists of 2-pyridinemethanol, 3-pyridinemethanol, 2-pyridineethanol, 3-pyridineethanol, and mixtures thereof.

10. The silver electroplating composition of claim 1, wherein a pH of the silver electroplating composition is 6-14.

11. A method of electroplating rough, matt silver on a substrate comprising:

a) providing the substrate;

b) contacting the substrate with the silver electroplating composition of claim 1; and c) applying an electric current to the silver electroplating composition and substrate to electroplate a rough, matt silver deposit on the substrate.

12. The method of claim 11, wherein the rough, matt silver deposit comprises a Sa of 0.1-0.4 μm and an Sdr of 5-50%.

13. The method of claim 11, wherein the rough, matt silver deposit has needle-like structures comprising a peak height of 1-4 μm and a peak base of 0.2-0.4 μm.

14. The method of claim 11, wherein a current density is 10 ASD to 180 ASD.

* * * * *